US011670262B2

(12) United States Patent
Cheng et al.

(10) Patent No.: US 11,670,262 B2
(45) Date of Patent: Jun. 6, 2023

(54) METHOD OF GENERATING OSD DATA

(71) Applicant: NOVATEK Microelectronics Corp., Hsin-Chu (TW)

(72) Inventors: Yuan-Po Cheng, Hsinchu County (TW); Hung-Ming Wang, Tainan (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 100 days.

(21) Appl. No.: 17/381,180

(22) Filed: Jul. 20, 2021

(65) Prior Publication Data

US 2023/0021833 A1 Jan. 26, 2023

(51) Int. Cl.
*G09G 5/397* (2006.01)
*G09G 3/36* (2006.01)

(52) U.S. Cl.
CPC ..... *G09G 5/397* (2013.01); *G09G 3/3648* (2013.01); *G09G 2340/12* (2013.01)

(58) Field of Classification Search
CPC .. G09G 5/397; G09G 3/3648; G09G 2340/12; H04N 13/183
See application file for complete search history.

(56) References Cited

U.S. PATENT DOCUMENTS

2006/0044320 A1* 3/2006 Jeong ..... H04N 21/42653 345/581
2017/0308261 A1* 10/2017 Lee ..... G06F 3/04812
2018/0033172 A1* 2/2018 Zhu ..... H04N 5/44
2021/0134252 A1* 5/2021 Nakamura ..... H04N 5/14

* cited by examiner

*Primary Examiner* — Antonio A Caschera
(74) *Attorney, Agent, or Firm* — Winston Hsu

(57) ABSTRACT

A method for generating a plurality of on-screen display (OSD) data is used in a back-end (BE) circuit. The BE circuit is configured to process a plurality of image data to be displayed on a display device. The method includes steps of: receiving the plurality of image data from an application processor (AP); and extracting information of a detecting layer embedded in the plurality of image data, wherein the information of the detecting layer indicates the plurality of OSD data corresponding to at least one user-interface (UI) layer in the plurality of image data.

10 Claims, 7 Drawing Sheets

METHOD OF GENERATING OSD DATA

BACKGROUND OF THE INVENTION

1. Field of the Invention

The present invention relates to a method for a display device, and more particularly, to a method of generating on-screen display (OSD) data for a display device.

2. Description of the Prior Art

A back-end (BE) circuit (e.g., BE chip, or called image processing circuit or image post-processing circuit) is usually applied in a display system, for processing image data to be displayed. After an application processor (AP) generates a frame of image data, it may send the frame of image data to the BE circuit, and the BE circuit may perform several image post-processing operations such as frame rate conversion, noise reduction, and contrast adjustment on the received image data, so as to improve the visual effects and/or satisfy the specification of the display device. The image data after the image processing operations are then sent to the panel to be displayed.

The AP may generate the image data by incorporating a plurality of image layers, which are generated from different user-interface (UI) applications or image sources. In general, the image content may be composed of a video layer and at least one UI layer, where the video layer may include video content as a background received from a video source, and each UI layer, which may be generated from a UI application, is embedded in the video layer to be blended with the video content. The AP therefore sends the combination of all the image layers to the BE circuit for post-processing.

In order to facilitate the post-processing, the BE circuit may need to know whether the image data on each pixel is generated from the video layer or the UI layer. For example, in the output image of a mobile phone, the background wallpaper and push notification may need to be processed in different manners; hence, the BE circuit is requested to differentiate the image types. However, the image data output from the AP usually do not contain the related information. In the prior art, the AP may send an OSD bit indicating that the image data in each pixel comes from the video layer or the UI layer through an additional transmission interface. Therefore, the BE circuit may obtain a bitmap indicating the position of the UI layer and the position of the background video, and thereby perform the post-processing according to the OSD information.

The operations of sending the OSD bits to the BE circuit from the AP has several drawbacks. For example, the OSD bits may be sent to the BE circuit through an additional transmission interface or bandwidth, which is accompanied by additional hardware costs and higher power consumption. Since the AP is requested to determine the OSD bits, the AP should allocate computation resources to check whether each pixel has a UI image after blending the video layer with the UI layers. In addition, a great number of memory resources should be allocated to store the OSD bits. Further, it is also difficult for the BE circuit to map the received OSD bits to the correct frame and correct position, where the synchronization of the OSD bits and the image content requires a lot of efforts. Thus, there is a need for improvement over the prior art.

SUMMARY OF THE INVENTION

It is therefore an objective of the present invention to provide a novel method of generating the on-screen display (OSD) bits, so as to resolve the abovementioned problems.

An embodiment of the present invention discloses a method of generating a plurality of OSD data used in a back-end (BE) circuit. The BE circuit is configured to process a plurality of image data to be displayed on a display device. The method comprises steps of: receiving the plurality of image data from an application processor (AP); and extracting information of a detecting layer embedded in the plurality of image data, wherein the information of the detecting layer indicates the plurality of OSD data corresponding to at least one user-interface (UI) layer in the plurality of image data.

Another embodiment of the present invention discloses a method of generating a plurality of OSD data used in an AP. The AP is configured to generate a plurality of image data to be displayed on a display device. The method comprises steps of: embedding at least one UI layer and a detecting layer with a video layer to be displayed on the display device; and transmitting the plurality of image data blended with the at least one UI layer, the detecting layer and the video layer to a BE circuit. Wherein, the detecting layer is configured to detect the at least one UI layer.

These and other objectives of the present invention will no doubt become obvious to those of ordinary skill in the art after reading the following detailed description of the preferred embodiment that is illustrated in the various figures and drawings.

DETAILED DESCRIPTION

Figure 1B:
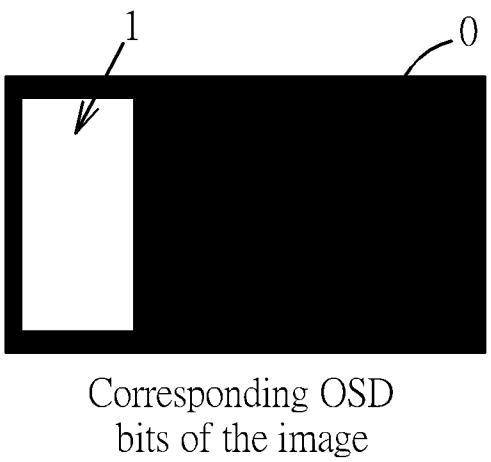
FIG. 1B shows the OSD bits corresponding to the image pattern of FIG. 1A.
Figure 1A:
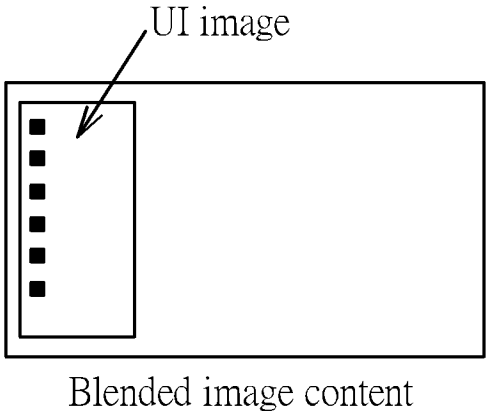
FIG. 1A is a schematic diagram of an exemplary image pattern.

Please refer to FIGS. 1A and 1B. FIG. 1A is a schematic diagram of an exemplary image pattern, and FIG. 1B shows the OSD bits corresponding to the image pattern of FIG. 1A. In an embodiment, the application processor (AP) may send the image data associated with the image pattern to the back-end (BE) circuit. This image pattern includes a background image in addition to a UI image. In detail, the image data output by the AP may be composed of a video layer and one or more user-interface (UI) layers. Different layers of image data may be generated from different image sources. For example, the image content of the video layer may be images generated or decoded from a video file or network stream data, and the UI layers may include a menu, push notification, status bar, time, battery power information, instant message, and/or any other message block that can overlay on the background picture/video. After blending the images of the video layer and the UI layer(s), the AP may send the blended image data to the BE circuit, which then processes the image data and forwards the image data to the display device for display.

An on-screen display (OSD) bitmap is a bit array mapped to a frame of image data, for indicating which pixels show the image of the video layer and which pixels show the image of the UI layer(s). In an embodiment, the OSD bit may be set to "1" if the corresponding pixel shows the UI image, and set to "0" if the corresponding pixel shows the background image, as shown in FIG. 1B. The size of the OSD bitmap may be exactly identical to the resolution of the display image, where one OSD bit is mapped to one pixel. Alternatively, the OSD bitmap may have a smaller size, so that the image information of several adjacent pixels may be indicated by one OSD bit. In another embodiment, one OSD data for a pixel or several adjacent pixels may be carried in several bits, which are capable of storing other information in addition to the existence of the UI layer(s), such information may include the degree of transparency, the ratio of blending the images, etc. For example, the OSD data may include several bits representing a value between "0" and "1", where "0" stands for the background image only, "1" stands for the UI image exactly blocking the background image, and other values stand for the ratio of UI image appearing on the pixel (s) in the blending of the UI and background images. In general, the UI image usually does not need excessive image processing in the BE circuit; hence, the BE circuit should obtain the related OSD data and perform the image post-processing according to the information carried in the OSD bitmap.

In an embodiment, the OSD data may be obtained by deliberately inserting a detecting layer in the blended images in the AP, where the image pattern of the detecting layer is predetermined and known by the BE circuit; hence, the OSD data may be extracted by the BE circuit according to the image data of the detecting layer. In such a situation, the additional efforts and resources for determination, storage, transmission and synchronization of the OSD bits can be saved.

Figure 2:
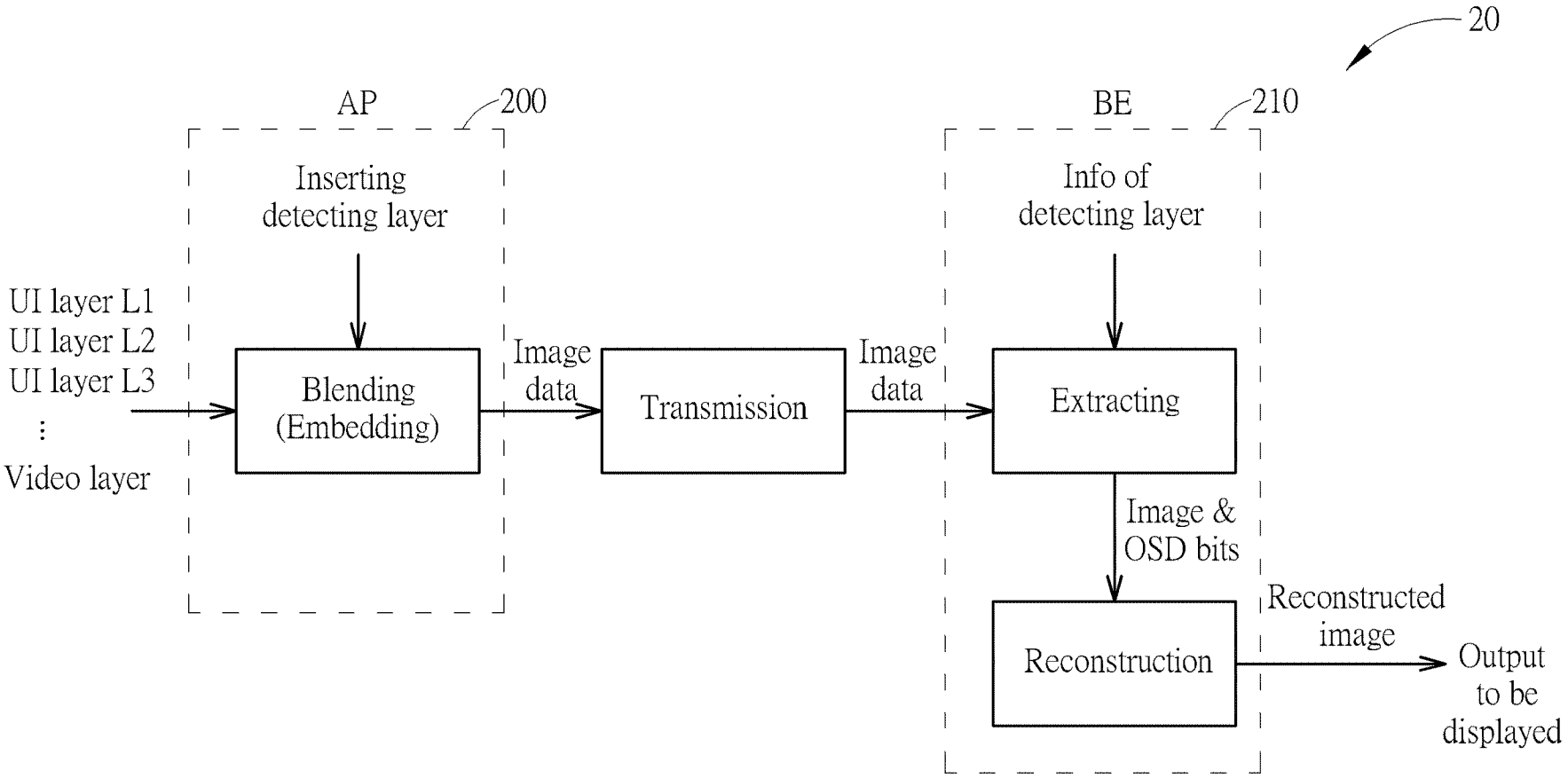
FIG. 2 is a flowchart performed in a display system according to an embodiment of the present invention.

Please refer to FIG. 2, which is a flowchart performed in a display system 20 according to an embodiment of the present invention. As shown in FIG. 2, the display system 20 includes an AP 200 and a BE circuit 210. The display system 20 may also include a display device such as a panel or screen (not illustrated). The AP 200 is configured to blend the video layer with the UI layers. More specifically, the AP 200 may embed UI layers L1-L3 with the video layer, where each UI layer L1-L3 may include a menu, push notification, and/or message block to be displayed on the display device. The AP 200 may also embed or insert a detecting layer with the video layer, where the detecting layer is used for detecting the UI layers L1-L3. Therefore, the AP 200 transmits the image data blended with the UI layers L1-L3, the detecting layer and the video layer to the BE circuit 210.

In an embodiment, the AP 200 may be, but not limited to, a system on chip (SoC) or any other main processing circuit implemented with an operating system (e.g., android) in which various applications can be installed, which may generate image content including the video and UI. A common example of the SoC is the Snapdragon series of Qualcomm. The BE circuit 210 may be, but not limited to, a graphics processing unit (GPU), discrete graphics processing unit (dGPU), independent display chip, independent motion estimation and motion compensation (MEMC) chip, or any other image processing circuit of an electronic device capable of display function. A common example of the BE circuit is the X1 processor of Sony. In another embodiment, the AP 200 may be an SoC of a set-top box of the television.

After receiving the image data, the BE circuit 210 may extract the information of the detecting layer embedded in the image data, and obtain the OSD data corresponding to the image data indicated by the extracted information, where the OSD data includes multiple OSD bits indicating whether the corresponding pixels have UI images or not. Since the BE circuit 210 already knows the image information of the inserted detecting layer, the BE circuit 210 may remove the image of the detecting layer based on the known information, so as to reconstruct the image content. Note that the detecting layer has an image pattern that does not need to be shown on the display device, and thus the image of the detecting layer should be removed before the BE circuit 210 outputs the image data.

Figure 3:
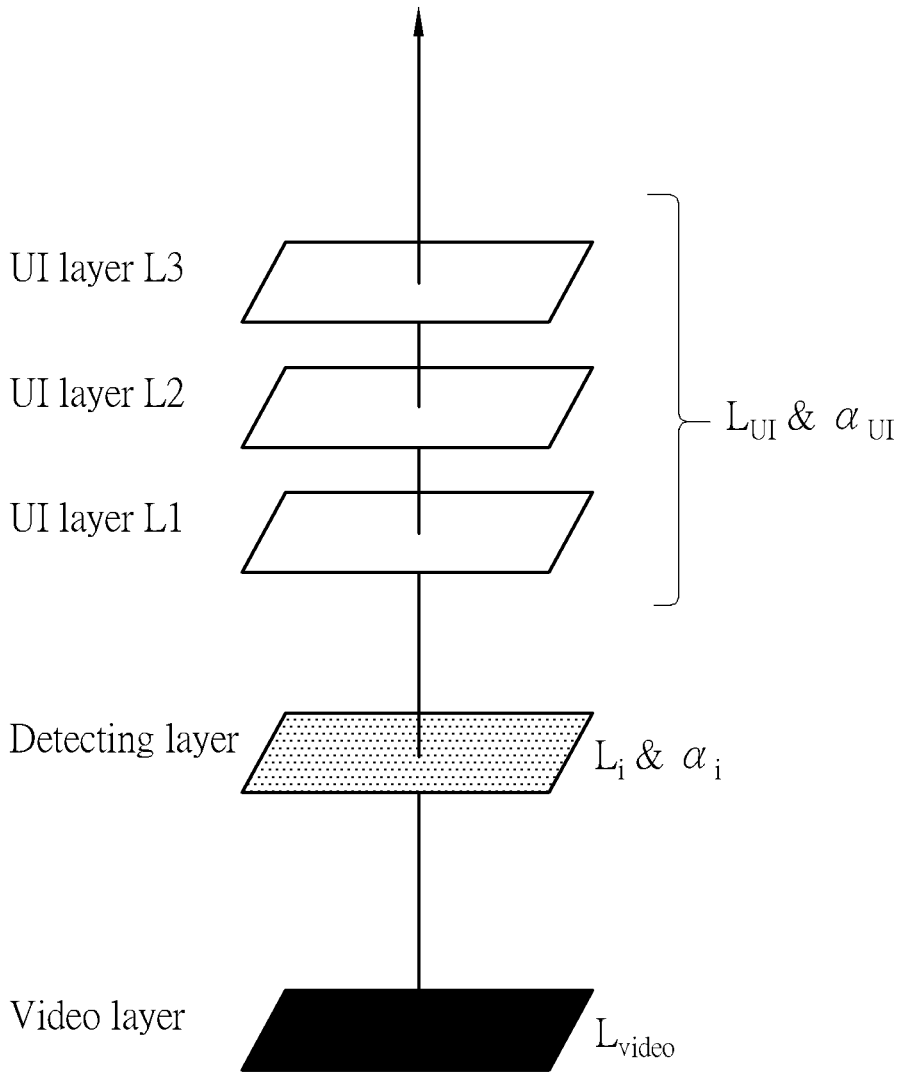
FIG. 3 illustrates a detailed implementation of inserting the detecting layer in the image.

FIG. 3 illustrates a detailed implementation of inserting the detecting layer in the image. The image data to be displayed may include a video layer and several UI layers (e.g., 3 UI layers L1-L3 in this embodiment). Each inserted UI layer has an image data and a related parameter $\alpha$ in each pixel, where the value of a indicates the transparency of the layer in the pixel. The final image data to be displayed will be determined based on the image data of each layer and the transparency parameter $\alpha$ of the UI layers. In an embodiment, the value of the transparency parameter $\alpha$ may be set between "0" and "1", where $\alpha=0$ means that the image of the layer in this pixel is fully transparent so that the below image can be shown, and $\alpha=1$ means that the image of the layer in this pixel is fully non-transparent so that the below image is entirely blocked.

Figure 4:
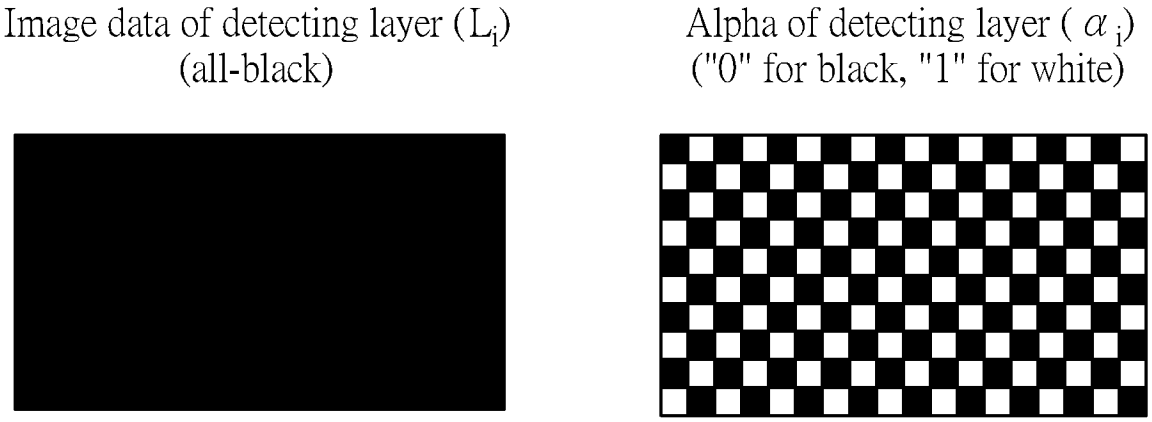
FIG. 4 illustrates an exemplary image pattern of the detecting layer.

In order to detect the UI layers L1-L3 and determine the OSD data corresponding to the UI layers L1-L3, a detecting layer having image data $L_i$ and transparency parameter $\alpha_i$ may be inserted between the UI layers L1-L3 and the video layer. The UI layers L1-L3, the detecting layer and the video layer superposed together construct the image to be output by the AP 200. FIG. 4 illustrates an exemplary image pattern of the detecting layer. As shown in FIG. 4, the detecting layer may have an all-black image, and the transparency parameter $\alpha_i$ of the detecting layer appears to be a checkerboard. In other words, the detecting layer has a transparent area and a non-transparent area, which are arranged alternately as a checkerboard pattern. Each white block or black block as shown in FIG. 4 may include only one pixel or a pixel array. In a preferable embodiment, each white block or black block in the checkerboard may represent one pixel, so that the checkerboard of the detecting layer may actually include a great number of blocks far more than those shown in FIG. 4. In such a situation, among every two adjacent pixels, one is allocated to the transparent area and the other is allocated to the non-transparent area. This achieves better OSD detection and reconstruction effects.

In the non-transparent area, the image information of the video layer is entirely blocked, and only the UI image may be shown (if there is a UI image). Therefore, the BE circuit 210 may extract the image information of the non-transparent area to determine the corresponding OSD data. More specifically, supposing that the detecting layer has an all-black image, if the BE circuit 210 finds that the image of a pixel in the non-transparent area is black, it may determine that the pixel seems to show the image of the detecting layer and there is no UI layer in this pixel, and thereby set the corresponding OSD bit to "0"; if the BE circuit 210 finds that the image of a pixel in the non-transparent area is not black, it may determine that the pixel seems to show a UI image and there may be at least one UI layer in this pixel (since the above UI layer (s) is/are not blocked by the non-transparent detecting layer), and thereby set the corresponding OSD bit to "1".

Please refer to FIG. 4 along with FIG. 3. As for a specific pixel, suppose that the UI layers L1-L3 have an image data $L_{UI}$ and transparency parameter $\alpha_{UI}$ as a whole; that is, the image data $L_{UI}$ and the transparency parameter $\alpha_{UI}$ are image parameters of the combination of the UI layers L1-L3. The image data of the video layer in this pixel is $L_{video}$. As mentioned above, the detecting layer includes a transparent area and a non-transparent area arranged alternately, where the transparency parameter $\alpha$, equals "0" in the transparent area and equals "1" in the non-transparent area. In addition, the image data of the detecting layer may equal "0" if it has an all-black image. Therefore, if the specific pixel is in the transparent area ($\alpha$=0), the output image data of this pixel may be obtained as:

$$\text{output image data}=L_{video}\times(1-\alpha_{UI})+L_{UI}\times\alpha_{UI},$$

which is the image content composed of the video layer and the UI layers to be shown on the display device. If the specific pixel is in the non-transparent area ($\alpha$=1), the output image data of this pixel may be obtained as:

$$\text{output image data}=L_{UI}\times\alpha_{UI},$$

where the image of the video layer is entirely blocked, and thus the UI layers L1-L3 above the detecting layer may be easily detected.

As mentioned above, the image pattern of the detecting layer is known information for the BE circuit 210; hence, the BE circuit 210 may obtain the OSD data according to the image information. Since only the UI image can be shown in the non-transparent area of the detecting layer, the BE circuit 210 may detect the OSD bits corresponding to the UI layers L1-L3 overlapping the non-transparent area of the detecting layer. As for those pixels in the transparent area, the corresponding OSD bits cannot be detected directly. Therefore, the BE circuit 210 may estimate the OSD bits in the transparent area through interpolation, e.g., calculating each OSD bit in the transparent area with reference to nearby pixels in the non-transparent area. In an embodiment, the BE circuit 210 may obtain an OSD bitmap corresponding to an image frame by combining the OSD data detected in the non-transparent area and the OSD data calculated in the transparent area.

Please note that the detecting layer may change the image to be output to the display device, especially in the non-transparent area, and thus the BE circuit 210 is requested to reconstruct the original image data without the image of the detecting layer. As mentioned above, the images in the transparent area are not affected by the detecting layer; hence, a frame of image data may be reconstructed based on the image data in the transparent area, so as to restore the images to be shown on the display device. In an embodiment, the image frame may be reconstructed through interpolation; that is, the BE circuit 210 may determine the image data in the non-transparent area with reference to nearby pixels in the transparent area. The reconstructed image frame may further be sent to the display device. In an embodiment, the reconstructed image frame including restored information of the UI layers, which may further be used to determine the OSD bitmap with a higher accuracy.

Therefore, it is preferable to allocate the image data and transparency parameters of the detecting layer such that the transparent area and the non-transparent area are arranged alternately (e.g., to become a checkerboard or similar pattern), so as to facilitate the reconstruction of the output image through interpolation.

Figure 5:
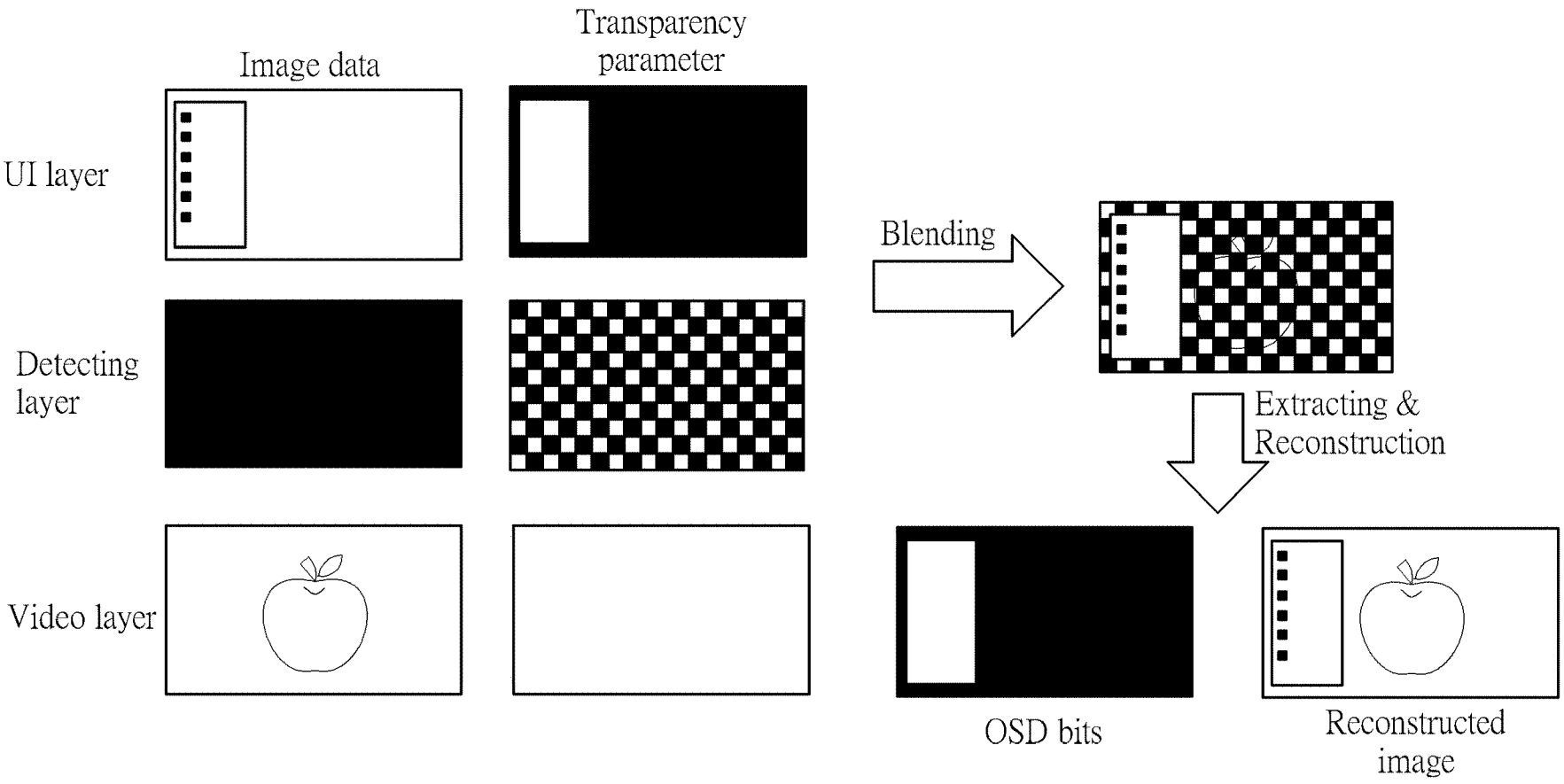
FIG. 5 is a schematic diagram of an image blended with a detecting layer to find out the OSD data according to an embodiment of the present invention.

Please refer to FIG. 5, where the image content of FIG. 1A is taken as an example, and this image is blended with a detecting layer to find out the OSD data. As shown in FIG. 5, the video layer shows a background image (having an apple), and the transparency parameter $\alpha$ of the video layer equals "1" in all pixels (i.e., non-transparent, where $\alpha$=1 is represented by white color). A UI layer overlaid on the video layer shows a message block at the left-hand side, and the transparency parameter $\alpha_{UI}$ equals "1" in the area of message block and equals "0" at other places (where $\alpha_{UI}$=1 is represented by white color and $\alpha_{UI}$=0 is represented by black color). A detecting layer, which has an all-black image data and the transparency parameter $\alpha_i$ in a checkerboard pattern, is inserted between the UI layer and the video layer. The AP 200 may blend the image content of the UI layer, the detecting layer and the video layer, and then send the blended image data to the BE circuit 210. Based on the information of the detecting layer, the BE circuit 210 may extract the OSD data to obtain that the OSD bits equal "1" in the area of the message block and equal "0" at other places. The BE circuit 210 may also reconstruct the output image based on the image data in the transparent area of the detecting layer.

Figure 6:
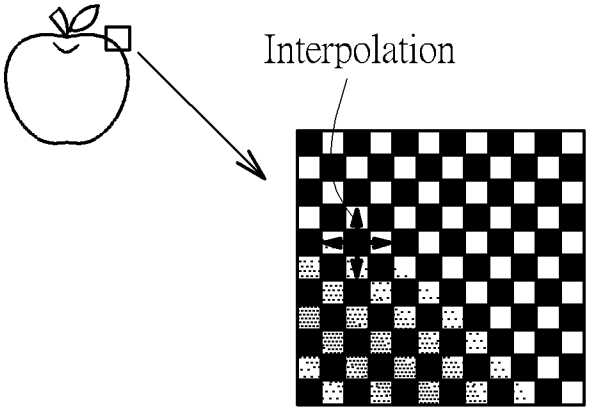
FIG. 6 illustrates a detailed implementation of the reconstruction operation.

FIG. 6 illustrates a detailed implementation of the reconstruction operation. When the transparency parameter of the detecting layer has a checkerboard pattern, the image data may be easily restored through interpolation based on 4 adjacent pixels. However, if the transparency parameter of the detecting layer does not have a checkerboard pattern or the non-transparent area is larger to contain several adjacent pixels, the image data in the non-transparent area may be reconstructed or restored with reference to a farther pixel.

In an embodiment, the image pattern of the detecting layer may be different for different image frames. For example, as for two consecutive image frames, the checkerboard pattern of the detecting layer may be changed; that is, a transparent pixel in this frame may be a non-transparent pixel in the next frame, and/or a non-transparent pixel in this frame may be a transparent pixel in the next frame. In such a situation, the BE circuit may reconstruct the image data based on those of the previous and/or next image frame, so as to achieve a better reconstruction effect.

In general, a UI layer embedded with the video layer is used to generate images to be shown on the display device. However, the detecting layer is served to detect the UI layer, and the image pattern of the detecting layer should be removed from the image data through reconstruction. Therefore, the images of the detecting layer may not be shown on the display device. This feature of the detecting layer is quite different from other UI layers.

Further, in order to successfully reconstruct the original image, the inserted detecting layer should be composed of the transparent area and the non-transparent area, and the transparent area may be arranged in a manner that allows the reconstruction to be performed correctly. In an embodiment, most pixels in an image frame may be allocated to the transparent area, and only a few pixels are allocated to the non-transparent area to be served to detect the OSD bits. Alternatively or additionally, the detecting layer may not include a large region (at least larger than a specific area or including more than a specific number of pixels) in which all pixels are allocated to the non-transparent area; that is, in a large region of the detecting layer, there should be at least one pixel allocated to the transparent area. In other words, the detecting layer may not have a great number of non-transparent pixels gathered together. In such a situation, the original blended image without the detecting layer may be reconstructed accurately.

In addition, the OSD bits can only be detected in the non-transparent area, but cannot be directly detected in the transparent area; hence, the OSD bits in the transparent area may be obtained with reference to nearby pixels. Also, if the UI image of a UI layer only appears on the transparent area of the detecting layer, this UI layer may not be successfully detected.

Moreover, the transparent area and the non-transparent area may be arranged in any manner, which is not limited to the checkerboard pattern as described in this disclosure. In an embodiment, the arrangement of the transparent pixels and non-transparent pixels may be adjusted appropriately in different places. For example, at the position(s) where the image of any UI layer probably appears, such as those areas close to the boarder of the panel or screen, non-transparent pixels may be allocated with a higher density, so as to achieve a better detection effect for the OSD bits. In contrast, at the position(s) where the image of the UI layer rarely appears, such as the middle display area, non-transparent pixels may be allocated with a lower density (where the transparent area may be larger), or there may be no non-transparent pixel in the position(s), so as to reconstruct the original image more easily and enhance the accuracy of the reconstruction.

Please note that the present invention aims at providing a method of generating the OSD data by inserting a detecting layer in the original output image. Those skilled in the art may make modifications and alterations accordingly. For example, in the above embodiments, the transparency parameter is "0" in the transparent area and "1" in the non-transparent area. However, in another embodiment, the transparency parameters of the detecting layer may be set to any values and/or adjusted with an appropriate manner. For example, the transparency parameter in the non-transparent area of the detecting layer may have a value approximately equal to "1", such as "0.95" or "0.9". In such a situation, the BE circuit may still determine the OSD data based on the image in the non-transparent area, and the output image may be reconstructed more effectively since the non-transparent area also includes image information of the video layer which is helpful in the image reconstruction. In addition, in the above embodiments, the detecting layer has an all-black image; but in another embodiment, other color may also be feasible. As long as the color of the detecting layer is different from the main color of the UI image and the color information is known by the BE circuit, the corresponding UI layer may be detected successfully. In an alternative embodiment, multiple colors may be applied in one detecting layer, and/or the detecting layers for different image frames may be composed of different colors, so as to achieve different detection effects.

Furthermore, in the above embodiments, the detecting layer is inserted above the video layer and below all of the UI layers. In another embodiment, the detecting layer may be inserted between the video layer and one or more target UI layers, and the OSD bits may be obtained for the target UI layer(s). For example, in the image layer architecture as shown in FIG. 3, if the detecting layer is inserted between the UI layers L1 and L2, only the UI layers L2 and L3 may be detected and the corresponding OSD data may be obtained (while the UI layer L1 below the detecting layer cannot be detected). In fact, the detecting layer may be inserted in any manner based on the blending implementations of the image layers in the AP, so as to detect the OSD data according to system requirements. For example, the BE circuit may need to process some UI images differently, and the OSD bits corresponding to these UI layers may be obtained.

Figure 7:
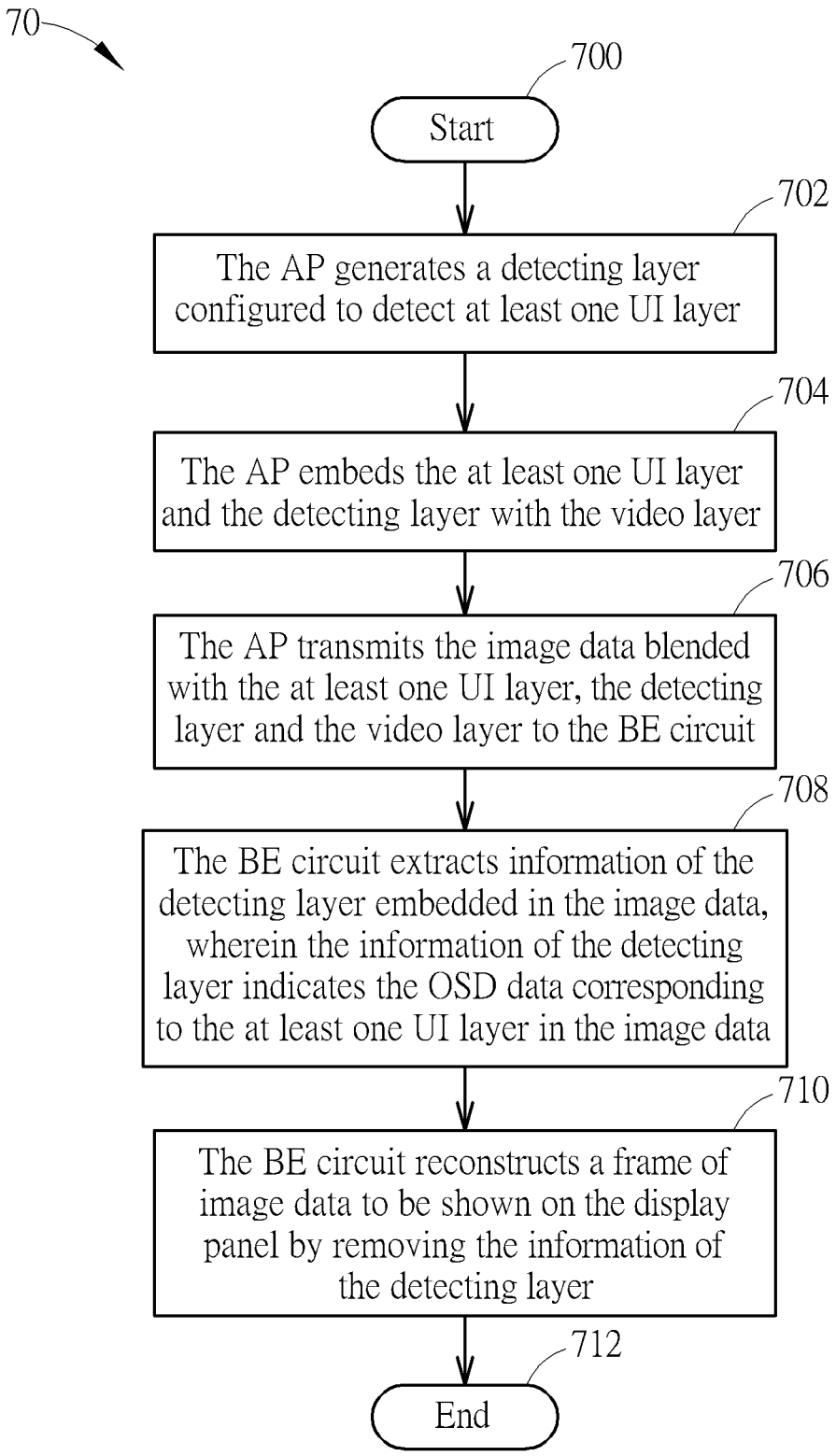
FIG. 7 is a flowchart of a process according to an embodiment of the present invention.

The abovementioned operations of generating the OSD data may be summarized into a process 70, as shown in FIG. 7. The process 70, which may be implemented in a display system having an AP and a BE circuit such as the display system 20 shown in FIG. 2, includes the following steps:

Step 700: Start.

Step 702: The AP generates a detecting layer configured to detect at least one UI layer.

Step 704: The AP embeds the at least one UI layer and the detecting layer with the video layer.

Step 706: The AP transmits the image data blended with the at least one UI layer, the detecting layer and the video layer to the BE circuit.

Step 708: The BE circuit extracts information of the detecting layer embedded in the image data, wherein the information of the detecting layer indicates the OSD data corresponding to the at least one UI layer in the image data.

Step 710: The BE circuit reconstructs a frame of image data to be shown on the display device by removing the information of the detecting layer.

Step 712: End.

The detailed operations and alterations of the process 70 are illustrated in the above paragraphs, and will not be narrated herein.

To sum up, the present invention provides a method of generating the OSD data by deliberately inserting a detecting layer in the blended image. The detecting layer may include a transparent area and a non-transparent area with different transparency parameters arranged as a checkerboard pattern, where the UI image and the video layer are shown in the transparent area, while the video layer is blocked and only the UI image is shown in the non-transparent area. Therefore, the OSD bits may be detected based on the image information obtained in the non-transparent area, and the OSD bits in the transparent area may be calculated with reference to nearby pixels in the non-transparent area, so as to generate an OSD bitmap. Since the transparent area includes the information of the original output image, the image data in the non-transparent area may be reconstructed with reference to nearby pixels in the transparent area through interpolation. As a result, the OSD data may be extracted from the image information more effectively, the display system does not need additional transmission interface or bandwidth for transmitting the OSD bits, and the OSD bits may be synchronous to the image content more easily and conveniently.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of generating a plurality of on-screen display (OSD) data, used in a back-end (BE) circuit, the BE circuit being configured to process a plurality of image data to be displayed on a display device, the method comprising:

receiving the plurality of image data from an application processor (AP); and extracting information of a detecting layer embedded in the plurality of image data, wherein the information of the detecting layer indicates the plurality of OSD data corresponding to at least one user-interface (UI) layer in the plurality of image data.

2. The method of claim 1, wherein an image of the detecting layer is not shown on the display device.

3. The method of claim 1, wherein the detecting layer comprises a transparent area and a non-transparent area, and the method further comprises:

detecting the plurality of OSD data corresponding to the at least one UI layer overlapping the non-transparent area of the detecting layer.

4. The method of claim 3, further comprising:

reconstructing a frame of image data to be shown on the display device according to the plurality of image data in the transparent area of the detecting layer.

5. The method of claim 3, wherein in a large region of the detecting layer, at least one pixel is allocated to the transparent area.

6. The method of claim 3, wherein pixels of the non-transparent area of the detecting layer arranged at a position in which an image of the at least one UI layer probably appears have a higher density than pixels of the non-transparent area of the detecting layer arranged at another position in which the image of the at least one UI layer rarely appears.

7. A method of generating a plurality of on-screen display (OSD) data, used in an application processor (AP), the AP being configured to generate image data to be displayed on a display device, the method comprising:

embedding at least one user-interface (UI) layer and a detecting layer with a video layer to generate a plurality of image data to be displayed on the display device; and transmitting the plurality of image data of the at least one UI layer, the detecting layer and the video layer to a back-end (BE) circuit, wherein the detecting layer is configured to detect the at least one UI layer.

8. The method of claim 7, wherein an image of the detecting layer is not shown on the display device.

9. The method of claim 7, wherein the detecting layer comprises a transparent area and a non-transparent area, and the plurality of OSD data are detected in the non-transparent area.

10. The method of claim 7, further comprising:

inserting the detecting layer between the at least one UI layer and the video layer.

* * * * *